US010795275B1

(12) United States Patent
Srinivasan et al.

(10) Patent No.: US 10,795,275 B1
(45) Date of Patent: Oct. 6, 2020

(54) CHEMICALLY PREPARED CORE SHELL MAGENTA TONER USING A BORAX COUPLING AGENT AND METHOD TO MAKE THE SAME

(71) Applicant: LEXMARK INTERNATIONAL, INC., Lexington, KY (US)

(72) Inventors: Kasturi Rangan Srinivasan, Longmont, CO (US); Ashley Schafer Grant, Lexington, KY (US); Michael James Bensing, Lexington, KY (US)

(73) Assignee: LEXMARK INTERNATIONAL, INC., Lexington, KY (US)

( * ) Notice: Subject to any disclaimer, the term of this patent is extended or adjusted under 35 U.S.C. 154(b) by 0 days.

(21) Appl. No.: 16/377,687

(22) Filed: Apr. 8, 2019

(51) Int. Cl.

| | |
|---|---|
| ***G03G 9/093*** | (2006.01) |
| ***G03G 9/08*** | (2006.01) |
| ***G03G 9/09*** | (2006.01) |
| ***G03G 9/087*** | (2006.01) |

(52) U.S. Cl.
CPC ..... *G03G 9/09392* (2013.01); *G03G 9/0804* (2013.01); *G03G 9/08755* (2013.01); *G03G 9/091* (2013.01); *G03G 9/09328* (2013.01); *G03G 9/09378* (2013.01); *G03G 9/0821* (2013.01)

(58) Field of Classification Search
CPC ..... G03G 9/0804
See application file for complete search history.

(56) References Cited

U.S. PATENT DOCUMENTS

| | | | | |
|---|---|---|---|---|
| 6,620,566 | B1 * | 9/2003 | Yamauchi | G03G 9/08755 399/223 |
| 2008/0286668 | A1 * | 11/2008 | Ishigami | G03G 9/0821 430/48 |
| 2013/0171551 | A1 * | 7/2013 | Sun | G03G 9/0804 430/108.1 |
| 2015/0378274 | A1 * | 12/2015 | Abe | G03G 9/09328 430/110.2 |

* cited by examiner

*Primary Examiner* — Peter L Vajda

(57) ABSTRACT

A method for producing a chemically prepared magenta toner composition according to one example embodiment includes combining and agglomerating a first polymer emulsion with a magenta colorant dispersion containing a single azo magenta pigment and a release agent dispersion to form toner cores. A borax coupling agent is added to the toner cores. A second polymer emulsion is combined and agglomerated with the toner cores having the borax coupling agent to form toner shells around the toner cores. The aggregated toner cores and toner shells are fused to form magenta toner particles. The single azo magenta pigment in the magenta pigment dispersion does not aggregate into clusters on the outer surface of the surface core.

8 Claims, 1 Drawing Sheet

CHEMICALLY PREPARED CORE SHELL MAGENTA TONER USING A BORAX COUPLING AGENT AND METHOD TO MAKE THE SAME

CROSS REFERENCES TO RELATED APPLICATIONS

None.

BACKGROUND

1. Field of the Invention

The present invention relates generally to a core shell magenta toner used in electrophotographic printers and more particularly to a chemically prepared core shell magenta toner that includes the combination of a single magenta pigment and a borax coupling agent and method to make the same. Surprisingly little or no magenta pigment particles aggregate on the toner surface, thereby producing a magenta toner having excellent print quality. Moreover, the single magenta pigment can be used at a lower concentration compared to magenta toners using a combination of magenta pigments but still provide a magenta toner having similar print quality.

2. Description of the Related Art

Toners for use in electrophotographic printers include two primary types, mechanically milled toners and chemically prepared toners (CPT). There are several known types of CPT including suspension polymerization toner (SPT), emulsion aggregation toner (EAT)/latex aggregation toner (LAT), toner made from a dispersion of pre-formed polymer in solvent (DPPT) and "chemically milled" toner. The electrophotographic printer transfers the toner from a reservoir to the media via a developer system utilizing differential charges generated between the toner particles and the various components in the developer system. The print darkness of the image is dependent on the pigment dispersibility in the toner matrix, the color gamut, and the toner charge. By using a pigment that disperses significantly better than most commercial pigments, a lower level of pigment can be used, without compromising on the print darkness.

It has been observed that in the process of making a magenta toner, the pigment particle that migrates to the toner surface has a tendency to be in clusters, i.e. the particle size is significantly higher than the primary particle size of the pigment in the native pigment dispersion. The tendency of magenta pigments towards aggregating on the surface of the toner unfortunately lowers the print density on a substrate due to the poor dispersibility of the magenta pigment across the toner surface and bulk. Accordingly, it will be appreciated that a magenta pigment that will not aggregate on the surface of the magenta toner particle is desirable in a magenta toner formulation.

SUMMARY

A chemically prepared core shell magenta toner composition according to one example embodiment includes a core including a mixture of polymer binders, a single magenta pigment and a release agent; a shell that is formed around the core and includes a third polymer binder; and a borax coupling agent between the core and the shell.

A method for producing core shell magenta toner according to a first example embodiment includes combining and agglomerating a mixture of polymer emulsions with a magenta pigment dispersion and a release agent dispersion to form toner cores. A borax coupling agent is added to the toner cores. A third polymer emulsion is combined and agglomerated with the toner cores having the borax coupling agent to form toner shells around the toner cores. The aggregated toner cores and toner shells are fused to form toner particles.

The present disclosure is directed at a toner formulation which comprises a new pigment namely, C.I. Pigment Red 293, which can be used at lower pigment loading. Although the C.I. Pigment Red 293 pigment has a tendency to increase the reinforcement with the polyester resin binder, the overall fusing performance is not compromised. The toner particles may be prepared by a chemical process, such as suspension polymerization or emulsion aggregation. In one example, the toner particles may be prepared via an emulsion aggregation procedure, which generally provides resin, colorant and other additives.

BRIEF DESCRIPTION OF THE DRAWINGS

The above-mentioned and other features and advantages of the various embodiments, and the manner of attaining them, will become more apparent and will be better understood by reference to the accompanying drawings.

DETAILED DESCRIPTION

Figure 1:
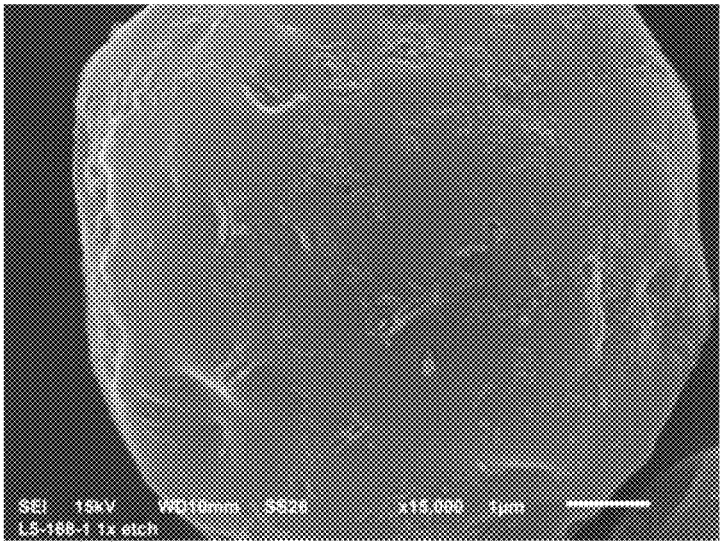
FIG. 1 is an image of an emulsion aggregation magenta toner particle using two different magenta pigments and a borax coupling agent between the core and the shell layers taken using a scanning electron microscope.

It is to be understood that the invention is not limited in its application to the details of construction and the arrangement of components set forth in the following description. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items.

For color toner applications, the use of an optimum pigment is critical to achieving the required color gamut, print density and performance through life. Whereas black, cyan and yellow toners tend to be based on a single pigment, magenta toner tends to require the use of multiple magenta pigments. There are several magenta pigments used to achieve the required color gamut. Magenta pigments can be based on quinacridones, naphthol, benzimidazolones, and azo. Quinacridones based magenta pigments include C.I. Pigment Red 122, C.I. Pigment Red 192, C.I. Pigment Red 202 and C.I. Pigment Red 202. A naphthol based azo pigment is C.I. Pigment Red 184. C.I. Pigment Red 185 is a benzimidazolone based magenta pigment. Most magenta toners on the market must use multiple magenta pigments identified hereinabove to achieve the required color density/gamut, melt rheology and light fastness. A magenta toner that uses a single magenta pigment and have excellent color density, melt rheology and overall improved efficiency in the print process is desirable.

Another problem with the use of magenta pigments in a magenta toner is the tendency of magenta pigments towards aggregating on the surface of the magenta toner. This aggregation unfortunately lowers the print density on a substrate due to the poor dispersibility of the magenta pigment across the toner surface and bulk. Accordingly, it will be appreciated that a magenta pigment that will not aggregate or show minimum aggregation on the surface of the magenta toner particle is desirable in a magenta toner formulation. There is a need to increase the pigment concentration to help overcome the aggregating behavior of the pigment in the toner medium, thereby increasing toner cost. Accordingly, a magenta pigment that is capable of being better dispersed in the toner matrix, and hence resulting in a lower pigment loading in the toner system is desirable. The inventors were surprised to find a new azo pigment, namely Color Index Pigment Red 293. C.I. Pigment Red 293 may be used in place of C.I. Pigment Red 122, C.I. Pigment Red 192, C.I. Pigment Red 202, C.I. Pigment Red 209, C.I. Pigment Red 184, and C.I. Pigment Red 185. Whereas most magenta color toners tend to use a combination of a quinacridone and azo pigments such as C.I. Pigment Red 122, C.I. Pigment Red 269, C.I. Pigment Red 184, C.I. Pigment Red 185, etc., C.I. Pigment Red 293 can be used as a single pigment. It may also be noted that in comparison to a higher pigment loading required for comparative pigments like (C.I. Pigment Red 122/C.I. Pigment Red 184, C.I. Pigment Red 122/C.I. Pigment Red 185), the pigment level used for C.I. Pigment Red 293 is about 50-60% of the levels used in comparative magenta pigment blends. The use of C.I. Pigment Red 293 renders good dispersibility of the pigment in the polyester resin matrix, and the resulting printed images exhibit the required optical density or L*. The use of a single pigment also helps in simplifying the toner preparation and helps lower cost.

The present disclosure relates to a chemically prepared magenta core shell toner containing a borax coupling agent between core and shell layers of the toner and a single azo magenta pigment and the associated emulsion aggregation method of preparation. The magenta toner is utilized in an electrophotographic printer. The toner is provided in a cartridge that supplies magenta toner to the electrophotographic printer. Example methods of forming toner using conventional emulsion aggregation techniques may be found in U.S. Pat. Nos. 6,531,254 and 6,531,256, 8,669,035 and 9,023,569 which are incorporated by reference herein in their entirety.

In the present emulsion aggregation process, the magenta toner particles are provided by chemical methods as opposed to physical methods such as pulverization. Generally, the toner includes one or more polymer binders, a release agent, a magenta colorant, a borax coupling agent and one or more optional additives such as a charge control agent (CCA). An emulsion of a polymer binder is formed in water, optionally with organic solvent, with an inorganic base such as sodium hydroxide, potassium hydroxide, ammonium hydroxide, or an organic amine compound. A stabilizing agent having an anionic functional group (A-), e.g., an anionic surfactant or an anionic polymeric dispersant may also be included. It will be appreciated that a cationic (C+) functional group, e.g., a cationic surfactant or a cationic polymeric dispersant, may be substituted as desired. The polymer latex is used at two points during the toner formation process. A first portion of the polymer latex is used to form the core of the resulting toner particle and a second portion of the polymer latex is used to form a shell around the toner core. The first and second portions of the polymer latex may be formed separately or together. Where the portions of the polymer latex forming the toner core and the toner shell are formed separately, either the same or different polymer binders may be used.

The magenta colorant, release agent, and the optional CCA are dispersed separately in their own aqueous environments or in one aqueous mixture, as desired, in the presence of a stabilizing agent having similar functionality (and ionic charge) as the stabilizing agent employed in the polymer latex. The polymer latex forming the toner core, the release agent dispersion, the colorant dispersion and the optional CCA dispersion are then mixed and stirred to ensure a homogenous composition. As used herein, the term dispersion refers to a system in which particles are dispersed in a continuous phase of a different composition (or state) and may include an emulsion. Acid is then added to reduce the pH and cause flocculation. Flocculation refers to the process by which destabilized particles conglomerate (due to e.g., the presence of available counterions) into relatively larger aggregates. In this case, flocculation includes the formation of a gel where resin, colorant, release agent and CCA form an aggregate mixture, typically from particles 1-2 microns (μm) in size. Unless stated otherwise, reference to particle size herein refers to the largest cross-sectional dimension of the particle. The aggregated magenta toner particles may then be heated to a temperature that is less than or around (e.g., ±5° C.) the glass transition temperature (Tg) of the polymer latex to induce the growth of clusters of the aggregate particles. Once the aggregate particles reach the desired size of the toner core, the borax coupling agent is added so that it forms on the surface of the toner core. Following addition of the borax coupling agent, the polymer latex forming the toner shell is added. This polymer latex aggregates around the toner core to form the toner shell. Once the aggregate particles reach the desired toner size, base may be added to increase the pH and reionize the anionic stabilizing agent to prevent further particle growth or one can add additional anionic stabilizing agents. The temperature is then raised above the glass transition temperature of the polymer latex(es) to fuse the particles together within each cluster. This temperature is maintained until the particles reach the desired circularity. The toner particles are then washed and dried.

The magenta toner particles produced have an average particle size of between about 3 μm and about 20 μm (volume average particle size) including all values and increments therebetween, such as between about 4 μm and about 15 μm or, more particularly, between about 5 μm and about 7 μm. The toner particles produced have an average degree of circularity between about 0.90 and about 1.00, including all values and increments therebetween, such as about 0.93 to about 0.98. The average degree of circularity and average particle size is determined by a Sysmex Flow Particle Image Analyzer (e.g., FPIA-3000) available from Malvern Instruments. The toner may then be treated with a blend of extra particulate agents, including hydrophobic fumed alumina, hydrophobic fumed small silica sized less than 20 nm, medium silica sized 40 nm to 50 nm, large fumed silica sized 70 nm to 80 nm, and titania. Treatment using the extra particulate agents may occur in one or more steps, wherein the given agents may be added in one or more steps.

It is also contemplated herein that the toner particles may be prepared by a number of other methods including mechanical methods, where a binder resin is provided, melted and combined with a wax, colorant and other optional additives. The product may then be solidified, ground and screened to provide toner particles of a given size or size range.

The various components for the emulsion aggregation method to prepare the above referenced magenta toner will be described below. It should be noted that the various features of the indicated components may all be adjusted to facilitate the step of aggregation and formation of toner particles of desired size and geometry. It may therefore be appreciated that by controlling the indicated characteristics, one may first form relatively stable dispersions, wherein aggregation may proceed along with relatively easy control of final toner particle size for use in an electrophotographic printer or printer cartridge.

Polymer Binder

As mentioned above, the toners herein include one or more polymer binders. The terms resin and polymer are used interchangeably herein as there is no technical difference between the two. In one embodiment, the polymer binder(s) include styrene-acrylate polymers. In an alternative embodiment, the polymer binder(s) include polyesters. The polyester binder(s) are amorphous and non-crystalline polyester binder. Alternatively, the polyester binder(s) may include a polyester copolymer binder resin. For example, the polyester binder(s) may include a styrene/acrylic-polyester graft copolymer. The polyester binder(s) may be formed using acid monomers such as terephthalic acid, trimellitic anhydride, dodecenyl succinic anhydride and fumaric acid. Further, the polyester binder(s) may be formed using alcohol monomers such as ethoxylated and propoxylated bisphenol A. Example polyester resins include, but are not limited to, T100, TF-104, NE-1582, NE-701, NE-2141, NE-1569, Binder C, FPESL-2, W-85N, TL-17, TPESL-10, TPESL-11 polyester resins from Kao Corporation, Bunka Sumida-ku, Tokyo, Japan, or mixtures thereof. The polymer binder(s) also includes a thermoplastic type polymer such as a styrene and/or substituted styrene polymer, such as a homopolymer (e.g., polystyrene) and/or copolymer (e.g., styrene-butadiene copolymer and/or styrene-acrylic copolymer, a styrene-butyl methacryla to copolymer and/or polymers made from styrene-butyl acrylate and other acrylic monomers such as hydroxy acrylates or hydroxyl methacrylates); polyvinyl acetate, polyalkenes, poly(vinyl chloride), polyurethanes, polyamides, silicones, epoxy resins, or phenolic resins.

Borax Coupling Agent

The coupling agent used herein is borax (also known as sodium borate, sodium tetraborate, or disodium tetraborate). As used herein the term coupling agent refers to a chemical compound having the cross-linking ability to bond two or more components together. Typically, coupling agents have multivalent bonding ability. Borax differs from commonly used permanent coupling agents, such as multivalent metal ions (e.g., aluminum and zinc), in that its bonding is reversible. In the electrophotographic process, toner is preferred to have a low fusing temperature to save energy and a low melt viscosity ("soft") to permit high speed printing at low fusing temperatures. However, in order to maintain the stability of the toner during shipping and storage and to prevent filming of the printer components, toner is preferred to be "harder" at temperatures below the fusing temperature. Borax provides cross-linking through hydrogen bonding between its hydroxy groups and the functional groups of the molecules it is bonded to. The hydrogen bonding is sensitive to temperature and pressure and is not a stable and permanent bond. For example, when the temperature is increased to a certain degree or stress is applied to the polymer, the bond will partially or completely break causing the polymer to "flow" or tear off. The reversibility of the bonds formed by the borax coupling agent is particularly useful in toner because it permits a "soft" toner at the fusing temperature but a "hard" toner at the storage temperature.

It has also been observed that borax surprisingly causes fine particles to collect on larger particles. As a result, borax is particularly suitable as a coupling agent between the core and shell layers of the toner because it collects the components of the toner core to the core particle before the shell is added thereby reducing the residual fine particles in the toner. This, in turn, reduces the amount of acid needed in the agglomeration stage and narrows the particle size distribution of the toner.

Borax also serves as a good buffer in the toner formation reaction as a result of the equilibrium formed by its boric acid and conjugate base. The presence of borax makes the reaction more resistant to pH changes and broadens the pH adjusting window of the reaction in comparison with a conventional emulsion aggregation process. The pH adjusting window is crucial in the industrial scale up of the process to control the particle size. With a broader window, the process is easier to control at an industrial scale.

The quantity of the borax coupling agent used herein can be varied. The borax coupling agent may be provided at between about 0.1% and about 5.0% by weight of the total polymer binder in the toner including all values and increments therebetween, such as between about 0.1% and about 1.0% or between about 0.1% and about 0.5%. If too much coupling agent is used, its bonding may not be completely broken at high temperature fusing. On the other hand, if too little coupling agent is used, it may fail to provide the desired bonding and buffering effects.

Colorant

Colorants are compositions that impart color or other visual effects to the toner and may include carbon black, dyes (which may be soluble in a given medium and capable of precipitation), pigments (which may be insoluble in a given medium) or a combination of the two. A colorant dispersion may be prepared by mixing the pigment in water with a dispersant. Alternatively, a self-dispersing magenta colorant may be used thereby permitting omission of the dispersant. The magenta colorant may be present in the dispersion at a level of about 5% to about 20% by weight including all values and increments therebetween. For example, the magenta colorant may be present in the dispersion at a level of about 10% to about 15% by weight. The dispersion of the magenta colorant may contain particles at a size of about 50 nanometers (nm) to about 500 nm including all values and increments therebetween. Further, the magenta colorant dispersion may have a pigment weight percent divided by dispersant weight percent (P/D ratio) of about 1:1 to about 8:1 including all values and increments therebetween, such as about 2:1 to about 5:1. The magenta colorant may be present at less than or equal to about 15% by weight of the final magenta toner formulation including all values and increments therebetween. An exemplary magenta pigment PR 293 is available from Clariant Corporation.

Release Agent

The release agent may include any compound that facilitates the release of toner from a component in an electrophotographic printer (e.g., release from a roller surface). For example, the release agent may include polyolefin wax, ester wax, polyester wax, polyethylene wax, metal salts of fatty acids, fatty acid esters, partially saponified fatty acid esters, higher fatty acid esters, higher alcohols, paraffin wax, carnauba wax, amide waxes and polyhydric alcohol esters.

The release agent may therefore include a low molecular weight hydrocarbon-based polymer (e.g., Mn<10,000) having a melting point of less than about 140° C. including all values and increments between about 50° C. and about 140° C. For example, the release agent may have a melting point of about 60° C. to about 135° C., or from about 65° C. to about 100° C., etc. The release agent may be present in the dispersion at an amount of about 5% to about 35% by weight including all values and increments therebetween. For example, the release agent may be present in the dispersion at an amount of about 10% to about 18% by weight. The dispersion of release agent may also contain particles at a size of about 50 nm to about 1 μm including all values and increments therebetween. In addition, the release agent dispersion may be further characterized as having a release agent weight percent divided by dispersant weight percent (RA/D ratio) of about 1:1 to about 30:1. For example, the RA/D ratio may be about 3:1 to about 8:1. The release agent may be provided in the range of about 2% to about 20% by weight of the final toner formulation including all values and increments therebetween.

Surfactant/Dispersant

A surfactant, a polymeric dispersant or a combination thereof may be used. The polymeric dispersant may generally include three components, namely, a hydrophilic component, a hydrophobic component and a protective colloid component. Reference to hydrophobic refers to a relatively non-polar type chemical structure that tends to self-associate in the presence of water. The hydrophobic component of the polymeric dispersant may include electron-rich functional groups or long chain hydrocarbons. Such functional groups are known to exhibit strong interaction and/or adsorption properties with respect to particle surfaces such as the colorant and the polyester binder resin of the polyester resin emulsion. Hydrophilic functionality refers to relatively polar functionality (e.g., an anionic group) which may then tend to associate with water molecules. The protective colloid component includes a water-soluble group with no ionic function. The protective colloid component of the polymeric dispersant provides extra stability in addition to the hydrophilic component in an aqueous system. Use of the protective colloid component substantially reduces the amount of the ionic monomer segment or the hydrophilic component in the polymeric dispersant. Further, the protective colloid component stabilizes the polymeric dispersant in lower acidic media. The protective colloid component generally includes polyethylene glycol (PEG) groups. The dispersant employed herein may include the dispersants disclosed in U.S. Pat. Nos. 6,991,884 and 5,714,538, which are incorporated by reference herein in their entirety.

The surfactant, as used herein, may be a conventional surfactant known in the art for dispersing non-self-dispersing colorants and release agents employed for preparing toner formulations for electrophotography. Commercial surfactants such as the AKYPO series of carboxylic acids from AKYPO from Kao Corporation, Bunka Sumida-ku, Tokyo, Japan may be used. For example, alkyl ether carboxylates and alkyl ether sulfates, preferably lauryl ether carboxylates and lauryl ether sulfates, respectively, may be used. One particular suitable anionic surfactant is AKYPO RLM-100 available from Kao Corporation, Bunka Sumida-ku, Tokyo, Japan, which is laureth-11 carboxylic acid thereby providing anionic carboxylate functionality. Other anionic surfactants contemplated herein include alkyl phosphates, alkyl sulfonates and alkyl benzene sulfonates. Sulfonic acid containing polymers or surfactants may also be employed.

Optional Additives

The toner formulation of the present disclosure may also include one or more conventional charge control agents, which may optionally be used for preparing the toner formulation. A charge control agent may be understood as a compound that assists in the production and stability of a tribocharge in the toner. The charge control agent(s) also help in preventing deterioration of charge properties of the toner formulation. The charge control agent(s) may be prepared in the form of a dispersion in a manner similar to that of the colorant and release agent dispersions discussed above.

The toner formulation may include one or more additional additives, such as acids and/or bases, emulsifiers, UV absorbers, fluorescent additives, pearlescent additives, plasticizers and combinations thereof. These additives may be desired to enhance the properties of an image printed using the present toner formulation. For example, UV absorbers may be included to increase UV light fade resistance by preventing gradual fading of the image upon subsequent exposures to ultraviolet radiations. Suitable examples of the UV absorbers include, but are not limited to, benzophenone, benzotriazole, acetanilide, triazine and derivatives thereof. Commercial plasticizers that are known in the art may also be used to adjust the coalescing temperature of the toner formulation.

The following examples are provided to further illustrate the teachings of the present disclosure, not to limit the scope of the present disclosure.

EXAMPLES

Preparation of Example Magenta Pigment Dispersion

About 15 g of AKYPO RLM-100 polyoxyethylene(10) lauryl ether carboxylic acid from Kao Corporation, Bunka Sumida-ku, Tokyo, Japan was combined with about 300 g of de-ionized water and the pH was adjusted to ~7-9 using sodium hydroxide. About 15 g of Solsperse 27000 from Lubrizol Advanced Materials, Cleveland, Ohio, USA was added, and the dispersant and water mixture was blended with an electrical stirrer followed by the relatively slow addition of 150 g of C.I. Pigment Red 122. Once the pigment was completely wetted and dispersed, the mixture was added to a horizontal media mill to reduce the particle size. The solution was processed in the media mill until the particle size was about 200 nm. The final pigment dispersion was set to contain about 30% to about 35% solids by weight.

Preparation of Example Magenta Pigment Dispersion B

About 18.75 g of AKYPO RLM-100 polyoxyethylene(10) lauryl ether carboxylic acid from Kao Corporation, Bunka Sumida-ku, Tokyo, Japan was combined with about 400 g of de-ionized water and the pH was adjusted to ~7-9 using sodium hydroxide. About 7.5 g of Solsperse 27000 from Lubrizol Advanced Materials, Cleveland, Ohio, USA was added, and the dispersant and water mixture was blended with an electrical stirrer followed by the relatively slow addition of 150 g of C.I. Pigment Red 184. Once the pigment was completely wetted and dispersed, the mixture was added to a horizontal media mill to reduce the particle size. The solution was processed in the media mill until the particle size was about 245 nm. The final pigment dispersion was set to contain about 20% to about 30% solids by weight.

Preparation of Example Magenta Pigment Dispersions C

About 15 g of AKYPO RLM-100 polyoxyethylene(10) lauryl ether carboxylic acid from Kao Corporation, Bunka Sumida-ku, Tokyo, Japan was combined with about 300 g of de-ionized water and the pH was adjusted to ~7-9 using sodium hydroxide. About 15 g of Solsperse 27000 from Lubrizol Advanced Materials, Cleveland, Ohio, USA was added, and the dispersant and water mixture was blended with an electrical stirrer followed by the relatively slow addition of 150 g of C.I. Pigment Red 293. Once the pigment was completely wetted and dispersed, the mixture was added to a horizontal media mill to reduce the particle size. The solution was processed in the media mill until the particle size was about 250 nm. The final pigment dispersion was set to contain about 30% to about 35% solids by weight.

Example Wax Emulsion

About 12 g of AKYPO RLM-100 polyoxyethylene(10) lauryl ether carboxylic acid from Kao Corporation, Bunka Sumida-ku, Tokyo, Japan was combined with about 325 g of de-ionized water and the pH was adjusted to ~7-9 using sodium hydroxide. The mixture was then processed through a microfluidizer and heated to about 90° C. About 60 g of polyethylene wax from Petrolite, Corp., Westlake, Ohio, USA was slowly added while the temperature was maintained at about 90° C. for about 15 minutes. The emulsion was then removed from the microfluidizer when the particle size was below about 300 nm. The solution was then stirred at room temperature. The wax emulsion was set to contain about 10% to about 18% solids by weight.

Example Polyester Resin Emulsion A

A mixed polyester resin having a peak molecular weight of about 11,000, a glass transition temperature (Tg) of about 55° C. to about 58° C., a melt temperature (Tm) of about 115° C., and an acid value of about 8 to about 13 was used. The glass transition temperature is measured by differential scanning calorimetry (DSC), wherein, in this case, the onset of the shift in baseline (heat capacity) thereby indicates that the Tg may occur at about 53° C. to about 58° C. at a heating rate of about 5 per minute. The acid value may be due to the presence of one or more free carboxylic acid functionalities (—COOH) in the polyester. Acid value refers to the mass of potassium hydroxide (KOH) in milligrams that is required to neutralize one gram of the polyester. The acid value is therefore a measure of the amount of carboxylic acid groups in the polyester.

150 g of the mixed polyester resin was dissolved in 450 g of methyl ethyl ketone (MEK) in a round bottom flask with stirring. The dissolved resin was then poured into a beaker. The beaker was placed in an ice bath directly under a homogenizer. The homogenizer was turned on at high shear and 10 g of 10% potassium hydroxide (KOH) solution and 500 g of de-ionized water were immediately added to the beaker. The homogenizer was run at high shear for about 2-4 minutes then the homogenized resin solution was placed in a vacuum distillation reactor. The reactor temperature was maintained at about 43° C. and the pressure was maintained between about 22 inHg and about 23inHg. About 500 mL of additional de-ionized water was added to the reactor and the temperature was gradually increased to about 70° C. to ensure that substantially all of the MEK was distilled out. The heat to the reactor was then turned off and the mixture was stirred until it reached room temperature. Once the reactor reached room temperature, the vacuum was turned off and the resin solution was removed and placed in storage bottles.

The particle size of the Polyester Resin Emulsion A was between about 190 nm and about 240 nm (volume average) as measured by a NANOTRAC Particle Size Analyzer. The pH of the resin solution was between about 7.5 and about 8.2.

Example Polyester Resin Emulsion B

A polyester resin having a peak molecular weight of about 6500, a glass transition temperature of about 49° C. to about 54° C., a melt temperature of about 95° C., and an acid value of about 21 to about 24 was used to form an emulsion using the procedure described in Example Polyester Resin A, except using 12.8 g of the 10% potassium hydroxide (KOH) solution.

The particle size of the Polyester Resin Emulsion B was between about 160 nm and about 220 nm (volume average) as measured by a NANOTRAC Particle Size Analyzer. The pH of the resin solution was between about 6.3 and about 6.8.

Example Polyester Resin Emulsion C

A polyester resin having a peak molecular weight of about 13,000, a glass transition temperature of about 58° C. to about 62° C., a melt temperature of about 117° C., and an acid value of about 20 to about 23 was used to form an emulsion using the procedure described in Example Polyester Resin A, except using 10 g of the 10% potassium hydroxide (KOH) solution.

The particle size of the Polyester Resin Emulsion C was between about 190 nm and about 240 nm (volume average) as measured by a NANOTRAC Particle Size Analyzer. The pH of the resin solution was between about 6.5 and about 7.0.

Toner Formulation Examples

Preparation of Comparative Toner 1

Components were added to a 5.0 liter reactor in the following relative proportions: 315 g (29.5%) of the Example Polyester Resin Emulsion A, 810 g (30.0%) of the Example Polyester Resin Emulsion B, 115 g (30%) of the Example Magenta Pigment Dispersion A and 62 g (30%) of the Example Magenta Pigment Dispersion B, 209 g (35%) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 16,000 rpm. Acid was slowly added to the high shear mixer to evenly disperse the acid in the toner mixture so that there were no pockets of low pH. Acid addition took about 6 minutes with 206 g of 2% sulfuric acid solution. The flow of the loop was then reversed to return the toner mixture to the reactor and the temperature of the reactor was increased to about 35-40° C. Once the particle size reached 5.0 μm to 5.2 μm (volume average), 5% (wt.) borax solution (20 g of solution having 1.0 g of borax) was added. After the addition of borax, 613 g (29.75%) of the Example Polyester Resin Emulsion C was added to form the shell. The mixture was stirred for about 5 minutes and the pH was monitored. Once the particle size reached 6.35 μm (volume average), 4% NaOH was added to raise the pH to about 6.8 to stop the particle growth. The reaction temperature was held for one hour. The temperature was increased to 82° C. to cause the particles to coalesce. This temperature was maintained until the particles reached their desired circularity. The final toner had a volume average particle size of 6.05 μm, and a number average particle size of 5.42 μm. Fines (<2 μm) were present at 0.37% (by number) and the toner possessed a circularity of 0.985.

Preparation of Comparative Toner 2

The preparation of Comparative Toner 2 is similar to the preparation of Comparative Toner 1, except 106 g of the Example Magenta Pigment Dispersion A and 57 g of the Example Magenta Pigment Dispersion B was used.

Preparation of Comparative Toner 3

The preparation of Comparative Toner 3 is similar to the preparation of Comparative Toner 1, except 98 g of the Example Magenta Pigment Dispersion A and 53 g of the Example Magenta Pigment Dispersion B was used.

Preparation of Toner 1

Components were added to a 5.0 liter reactor in the following relative proportions: 315 g (29.5%) of the Example Polyester Resin Emulsion A, 810 g (30.0%) of the Example Polyester Resin Emulsion B, 183 g (28.85%) of the Example Magenta Pigment Dispersion C, 209 g (35%) of the Example Wax Emulsion. Deionized water was then added so that the mixture contained about 12% to about 15% solids by weight.

The mixture was heated in the reactor to 25° C. and a circulation loop was started consisting of a high shear mixer and an acid addition pump. The mixture was sent through the loop and the high shear mixer was set at 16,000 rpm. Acid was slowly added to the high shear mixer to evenly disperse the acid in the toner mixture so that there were no pockets of low pH. Acid addition took about 6 minutes with 206 g of 2% sulfuric acid solution. The flow of the loop was then reversed to return the toner mixture to the reactor and the temperature of the reactor was increased to about 35-40° C. Once the particle size reached 5.0 μm to 5.2 μm (volume average), 5% (wt.) borax solution (20 g of solution having 1.0 g of borax) was added. After the addition of borax, 613 g (29.75%) of the Example Polyester Resin Emulsion C was added to form the shell. The mixture was stirred for about 5 minutes and the pH was monitored. Once the particle size reached 6.35 μm (volume average), 4% NaOH was added to raise the pH to about 6.8 to stop the particle growth. The reaction temperature was held for one hour. The temperature was increased to 82° C. to cause the particles to coalesce. This temperature was maintained until the particles reached their desired circularity. The final toner had a volume average particle size of 6.37 μm, and a number average particle size of 5.68 μm. Fines (<2 μm) were present at 0.49% (by number) and the toner possessed a circularity of 0.976.

Preparation of Toner 2

The preparation of Toner 2 is similar to the preparation of Toner 1, except 170 g of Magenta Pigment Dispersion C was used.

Preparation of Toner 3

The preparation of Toner 3 is similar to the preparation of Toner 1, except 157 g of Magenta Pigment Dispersion C was used.

TABLE 1

Characterization of Toners for Particle Size. Number average and volume average particle size is calculated between 2 μm and 15 μm. % Fines is based on a number distribution, between 0.6 μm-2 μm

| Toner ID | Pigment level/Type | Avg. Particle Diameter (Num.) | Avg. Particle Diameter (Vol) | Avg. Circu-larity | % Fines (Num.) |
|---|---|---|---|---|---|
| Comparative Toner 1 | 7% (PR122/PR184) | 5.42 | 6.05 | 0.985 | 0.37 |
| Comparative Toner 2 | 6.5% (PR122/PR184) | 5.39 | 5.99 | 0.986 | 0.15 |
| Comparative Toner 3 | 6% (PR122/PR184) | 5.42 | 6.05 | 0.986 | 0.21 |
| Toner 1 | 7% PR293 | 5.68 | 6.37 | 0.976 | 0.49 |
| Toner 2 | 6.5% PR293 | 5.55 | 6.27 | 0.977 | 0.9 |
| Toner 3 | 6% PR293 | 5.56 | 6.21 | 0.979 | 0.71 |

TABLE 2

Characterization of Toners for Thermal Properties

| Toner ID | Pigment level/Type | $1^{st}$ vs. $2^{nd}$/$3^{rd}$ scan Tg Onset | $1^{st}$ vs. $2^{nd}$/$3^{rd}$ scan Crystalline melt | $2^{nd}$/$3^{rd}$ scan Crystalline ΔHf J/g |
|---|---|---|---|---|
| Comparative Toner 1 | 7% (PR122/PR184) | 60/52 | 74/74 | 21.3 |
| Comparative Toner 2 | 6.5% (PR122/PR184) | 60/52 | 74/74 | 21.3 |
| Comparative Toner 3 | 6% (PR122/PR184) | 61/51 | 74/74 | 21.4 |
| Toner 1 | 7% PR293 | 60/52 | 74/74 | 21.4 |
| Toner 2 | 6.5% PR293 | 61/52 | 74/74 | 21.4 |
| Toner 3 | 6% PR293 | 60/52 | 74/74 | 21.4 |

As seen in Table 1, particle size for various toners were relatively similar, with relatively small differences in their circularity. Similarly, thermal properties such as glass transition temperature, crystalline melt for the wax and the wax incorporation as indicated by crystalline enthalpy of fusion as shown as ΔHf were similar.

Figure 2:
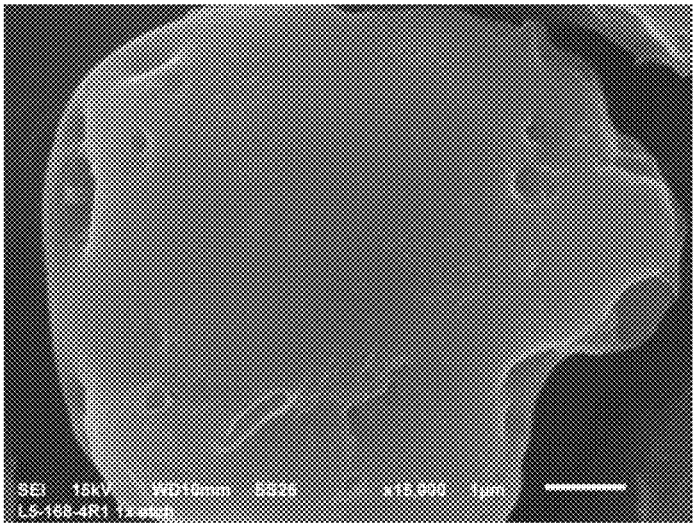
FIG. 2 is an image of an emulsion aggregation magenta toner particle using a single magenta pigment and a borax coupling agent between core and shell layers taken using a scanning electron microscope.

Toner 1 and Comparative Toner 1, prepared above, were characterized via scanning electron microscopy (SEM) and X-ray fluorescence spectroscopy (XPS). SEM images of toner were obtained for toners So as to study the surface of the toner, toners were subjected to oxygen plasma etching for varying times, from about 3 minutes to about 9 minutes. Toners thus etched was then studied using a SEM instrument. As shown in FIG. 1, Comparative Toner 1 exhibited wax and pigment domains on the surface that were >400 nm in size. In contrast, as shown in FIG. 2, Toner 1 having C.I. Pigment Red 293 did not exhibit domains relating to the pigment and crystalline wax that were readily observable. This result indicates that the pigment domain is relatively small, with little to no agglomeration of pigment on the toner surface. This also indicates that the pigment is relatively well dispersed in the toner bulk and hence not agglomerated on the toner surface. XPS analysis for the toner was also carried out. The instrument can measure the elements constituting the raw materials that are present on the toner surface. Toners analyzed here were not hydrophobized using surface additives such as silica or titania and hence the surface should give a measure of Carbon (% C), Oxygen (% O) and Nitrogen (% N), if any. It may be appreciated that in comparison to the polyester resin, crystalline wax and the pigment, the only source of Nitrogen (N) is the pigment. The table also indicates a lower amount of % N on the surface for Toner 3 in comparison to Comparative Example 3. Correlating the XPS data to SEM, it can be concluded that the magenta pigment in Toner 3 is possibly present to a smaller level in comparison to Comparative Example 3, thereby resulting in a lower % N, or less magenta pigment is present on the toner surface. The following table shows results obtained for two of the toners as shown below:

TABLE 3

XPS Analysis of Toners

| Sample ID | % C | % O | % N |
|---|---|---|---|
| Comparative Toner 3 | 79.81 | 18.63 | 1.56 |
| Toner 3 | 80.34 | 18.63 | 1.03 |

The dispersibility of the C.I. Pigment Red 293 in the toner matrix was assessed by selectively printing pages that had a pre-determined amount of toner on the developer roller. This was achieved by modifying the developer roller and charge roller voltages by 40V increments and the developer roller voltage was varied from about −300V to about −740V, and the corresponding voltages for the charge roller were −1100V to about −1540V. The toner mass on the developer roller was hence varied from about 0.15 mg/cm$^2$ to about 0.50 mg/cm$^2$. The following table illustrates the change in the print density as the toner mass on the developer roller was varied, for a select set of toner amount on the developer roller. Print density indicated by L* was measured using a Gretag X-ray spectrophotometer.

TABLE 4

Print Density as a Function of Toner Mass on Developer Roller

| Toner | L* @ 0.21 mg/cm$^2$ | L* @ 0.31 mg/cm$^2$ | L* @ 0.45 mg/cm$^2$ |
|---|---|---|---|
| Comp. Toner 1 | 58.6 | 53.9 | 48.8 |
| Comp. Toner 2 | 60.1 | 55.0 | 48.9 |
| Comp. Toner 3 | 63.4 | 55.9 | 50.3 |
| Toner 1 | 53.1 | 46.7 | 41.0 |
| Toner 2 | 52.3 | 47.7 | 43.2 |
| Toner 3 | 52.8 | 46.9 | 43.7 |

Toners 1 through 3, show a significantly lower L* than Comparative Toners 1 through 3. The lower L* or darker image is a result of the better dispersibility of the magenta pigment PR293. This result can also be validated using images obtained via a Scanning Electron Microscope, and further verified using XPS analyses of the non-hydrophobized toner. Results from Table 4 also indicate that the C.I. Pigment Red 293 pigment concentration can be lowered by as much as 40% to achieve the same print density as the Comparative toner 1-3. Importantly, this also helps lower the overall cost to manufacture a magenta toner.

Rheological properties for the toners were then studied, using a AR-G2 Rheometer, and measuring storage modulus (G'), elastic modulus or loss modulus (G") and complex viscosity (η) at various temperatures at 1 rad/sec and 63 rad/sec. Results are shown below, and for illustration purposes, two temperatures chosen were 120° C. and 200° C. MAFT corresponds to Minimum Acceptable Fuse Temperature, as measured off a bench top fuser robot, and acceptable temperature would be a print that shows no loss in fused image on scratching and <0.04 in a tape lift-off. Bench top fuser robot was run at about 60 ppm, with a dwell time of about 30 msec.

TABLE 5

Rheological Properties and Fusing Performance of Toners

| Toner ID | G' (Pa) (120° C./ 200° C.) | G" (Pa) (120° C./ 200° C.) | η (Pa.s) (120° C./ 200° C.) | MAFT |
|---|---|---|---|---|
| Comparative Toner 1 | 839/836 | 1695/399 | 1892/926 | 170° C. |
| Comparative Toner 2 | 747/679 | 1567/341 | 1736/760 | |
| Comparative Toner 3 | 670/538 | 1342/262 | 1682/598 | |
| Toner 1 | 6679/8142 | 4250/11310 | 7916/13930 | 175° C. |
| Toner 2 | 6193/17030 | 4303/9801 | 7541/19300 | |
| Toner 3 | 4620/12720 | 3856/7150 | 6017/14590 | |

As seen in Table 3, Toners 1-3 exhibit significantly higher elastic, storage modulus, and complex viscosity (η) compared to Comparative Toners 1-3. In a typical case, the goal would be to lower the complex viscosity, so that the toner is capable of fusing even at a lower temperature. Based on this assumption, Toners 1-3 would be expected to show relatively poor fusing behavior. However, using a bench top fusing robot, surprisingly Toners 1-3 only required an additional 5° C. to achieve similar fusing properties as Comparative Toner 1-3.

Toners were then evaluated in a Lexmark CS725 printer, at a print speed of about 50 ppm. Test was run using a 2.5% coverage page, at lab ambient and a run mode of about 4 page and pause. Test was run to about 10000 pages, and results are shown below:

| Toner | Q/M (μC/g) (0K/10K) | M/A (mg/cm$^2$) (0K/10K) | Avg. L* | Avg. Developer Voltage | Toner Usage (mg/pg) |
|---|---|---|---|---|---|
| Comp. Toner 1 | −69.7/−53.2 | 0.34/0.37 | 49.30 | −810 V | 10.7 |
| Comp. Toner 2 | −65.6/−53.8 | 0.31/0.39 | 49.92 | −820 V | 16.1 |
| Comp. Toner 3 | −68.7/−52.7 | 0.36/0.37 | 50.36 | −820 V | 11.8 |
| Toner 1 | −72.5/−50.5 | 0.35/0.41 | 48.59 | −390 V | 9.0 |
| Toner 2 | −72.4/−52.0 | 0.32/0.37 | 49.41 | −430 V | 5.9 |
| Toner 3 | −71.6/−51.8 | 0.34/0.37 | 50.59 | −430 V | 6.8 |

As can be seen from the above table, Toners 1-3 exhibited a higher initial toner charge at OK pages compared to Comparative Toners 1-3. Although the initial charge for Toners 1-3 is higher compared to the initial charge of Comparative Toners 1-3, the toner charge and mass as measured by a lift-off mechanism off the developer roller are similar. The better dispersibility of pigment C.I. Pigment Red 293 in Toners 1-3 is evidenced in the developer roller voltage required to achieve the required print density on page. Whereas Toners 1-3 required only about −430V and −390V, the printer had to be stressed and operated at a significantly higher voltage of −820V and −810V for the Comparative Toners 1-3. Toners 1-3 required a lower voltage to achieve the required print density. Toners 1-3 also had a lower amount of toner usage on a per page basis.

The invention claimed is:

1. A method for producing a chemically processed magenta toner comprising:

combining a first polymer emulsion with a magenta colorant dispersion containing a single azo magenta Pigment Red 293 and a release agent dispersion to form toner cores;

adjusting the pH of the combination of the first polymer emulsion, the magenta colorant dispersion and the release agent dispersion to promote agglomeration of the toner cores;

once the toner cores reach a predetermined size, adding a borax coupling agent to the toner cores;

combining a second polymer emulsion with the toner cores having the borax coupling agent and forming toner shells around the toner cores;

once a desired toner particle size is reached, adjusting the pH of the mixture of aggregated toner cores and toner shells to prevent additional particle growth; and fusing the aggregated toner cores and toner shells to form magenta toner particles, whereby an accumulation of the magenta toner particles results in a magenta toner composition, the single azo magenta Pigment Red 293 being present in the magenta toner composition from 2% to 8% and a viscosity of the magenta toner composition is at least 6000 η(Pa) or greater at 120° C., wherein a mass of the magenta toner composition existing on a developer roll in an electrophotographic printer is measurable in a range per area from 0.15 $mg/cm^2$ to 0.5 $mg/cm^2$ and exhibits an image print density L* measured by an X-ray spectrophotometer or scanning electron microscope of less than 46.7.

2. The method for producing a chemically processed magenta toner composition of claim 1, wherein the single azo magenta Pigment Red 293 is present in the magenta toner composition from about 6% to about 7%.

3. The method for producing a chemically processed magenta toner composition of claim 1, wherein a percentage of nitrogen on an outer surface of the toner core is <1.5%.

4. The method for producing a chemically processed magenta toner composition of claim 1, wherein the viscosity of the magenta toner composition is about 6017 η(Pa) at 120° C.

5. The method for producing a chemically processed magenta toner composition of claim 1, wherein the viscosity of the magenta toner composition is about 7541 η(Pa) at 120° C.

6. The method for producing a chemically processed magenta toner composition of claim 1, wherein the viscosity of the magenta toner composition is about 7916 η(Pa) at 120° C.

7. The method for producing a chemically processed magenta toner of claim 1, wherein the first polymer emulsion and the second polymer emulsion each include a polyester resin.

8. The method for producing a chemically processed magenta toner of claim 7, wherein the first polymer emulsion includes a first polyester resin or mixture and the second polymer emulsion includes a second polyester resin or mixture different from the first polyester resin or mixture.

* * * * *